US007338007B2

(12) United States Patent
Valot

(10) Patent No.: US 7,338,007 B2
(45) Date of Patent: Mar. 4, 2008

(54) PAPER TOWEL DISPENSER

(76) Inventor: Eduardo Alfredo Valot, Chacabuco 96, 2nd Piso, 1069 Buenos Aires (AR)

( * ) Notice: Subject to any disclaimer, the term of this patent is extended or adjusted under 35 U.S.C. 154(b) by 2 days.

(21) Appl. No.: 11/386,599

(22) Filed: Mar. 22, 2006

(65) Prior Publication Data

US 2007/0221777 A1 Sep. 27, 2007

(51) Int. Cl.
*B65H 19/10* (2006.01)

(52) U.S. Cl. ..... 242/559; 242/560

(58) Field of Classification Search ..... 242/558, 242/559, 560, 564, 564.1, 564.2, 564.3, 564.4, 242/563, 563.1, 563.2, 560.1, 560.2, 560.3
See application file for complete search history.

(56) References Cited

U.S. PATENT DOCUMENTS 2,299,301 A * 10/1942 Britt et al. ..... 242/560.3
3,700,181 A * 10/1972 Diring et al. ..... 242/560.3
4,010,909 A * 3/1977 Bastian ..... 242/560.1
4,067,509 A * 1/1978 Graham et al. ..... 242/560.1
4,358,169 A * 11/1982 Filipowicz et al.
4,441,392 A * 4/1984 DeLuca
4,944,466 A * 7/1990 Jespersen ..... 242/560.3
5,271,574 A * 12/1993 Formon et al. ..... 242/560.3
5,288,032 A * 2/1994 Boone et al. ..... 242/560.3
5,302,167 A * 4/1994 Kley et al.
5,558,302 A * 9/1996 Jesperson ..... 242/560
6,145,779 A * 11/2000 Johnson et al. ..... 242/560.1
6,302,351 B1 * 10/2001 Omdoll et al.

* cited by examiner

*Primary Examiner*—William A Rivera
(74) *Attorney, Agent, or Firm*—Evelyn A. Defillo; Defillo & Associates, Inc.

(57) ABSTRACT

The present invention relates to a paper towel dispenser in which the towels are provided from a reel enrolled around a central nucleus. The nucleus has at both ends guiding devices of the reel along both lateral descending grooves; thus, the reel can slide in a descending direction until the periphery of said reel is supported by a gyratory stop. When the external diameter of the reel decreases it continues sliding along the grooves until the guiding means enter into unlocking devices of the reels making the reel descend until the guiding devices push downwards a posterior end of a lever, the other end of said lever having indicating devices and threading devices of a new reel. Said posterior end ejects the nucleus when it is empty towards a cavity in the inferior part of the dispenser in order to be taken away afterwards.

8 Claims, 4 Drawing Sheets

16

30
3
32
17
7'
10
2
4
9
11
21
31
13
5
6
20
33
17'
14
5'
18
8
19
15

PAPER TOWEL DISPENSER

BACKGROUND OF THE INVENTION

1. Field of the Invention

The present invention concerns a paper towel dispenser device. Furthermore, the present invention concerns a paper towel dispenser wherein an alert signal carried out by the device is activated when there are a few towels left; thus, a new paper towel roll can be placed before the old roll runs out of the towels.

2. Description of the Prior Art

U.S. Pat. No. 3,917,191 discloses a paper towel dispenser in which there are, simultaneously, a primary reel and a reserve reel that transfer the supply of the towels from the primary reel to the reserve reel by means of a mechanism that works upon the tension of the sheet provided by the towels.

U.S. Pat. No. 6,908,069 discloses a device that consists of an indicator that alerts that the paper reserve is low.

The difference between the invention of U.S. Pat. No. 4,067,509 and the present invention is in the '509 reference the reserve reel must be collocated inside the dispenser in a predetermined location in order to provide for towels when there are still some towels left in the primary reel. On the contrary, in the present invention, the original reel is replaced directly by the new reel when there are very few towels left in the original reel, after the alert signal indicates that the supply of towels is low. This process is carried out without changing the position of the reels as in the aforementioned patent and moreover, without displacing parts of the mechanism in order to thread the new reel.

Furthermore, in the invention of the '509 patent, the new threading is produced by a lack of tension in the portion of paper that is found between the primary reel and the supplying towel mechanism, which makes the threading to be produced automatically also when that paper portion is cut—which occurs frequently—. On the contrary in the present invention the indication of a low supply of paper is produced when the diameter of the reel reaches a lower level than a predetermined level.

SUMMARY OF THE INVENTION

The object of this invention is to provide a paper towel dispenser wherein an alert signal carried out by the device is activated when there are a few towels left; thus, a new paper towel roll can be placed before the old roll runs out of the towels.

Another object of this invention is to provide a paper towel dispenser in which the towels are provided from a reel enrolled around a central nucleus.

Said nucleus has at both ends guiding means of the reel along both lateral descending grooves, in such a way that the reel can slide in a descending direction through the grooves until the periphery of said reel is supported by a gyratory stop; and when the external diameter of the reel decreases, it continues sliding along the grooves until said guiding means enter into unlocking means of the reels making said reel descend until the guiding means push downwards a posterior end of a lever; the other end has indicating means and threading means of a new reel. Said posterior end ejects the nucleus when it is empty, towards a cavity in the inferior part of the dispenser, in order to be taken away afterwards.

The foregoing detailed description is intended to be illustrative and non-limiting. Many changes and modifications are possible in light of the above teachings. Thus, it is understood that the invention may be practiced than as otherwise specifically described herein and still be within the scope of the appended claims.

BRIEF DESCRIPTION OF THE DRAWINGS

For a fuller understanding of the nature and objects of the invention, reference should be made to the following detailed description taken in connection with the accompanying drawings in which.

DETAILED DESCRIPTION OF THE PRESENT INVENTION

Figure 1:
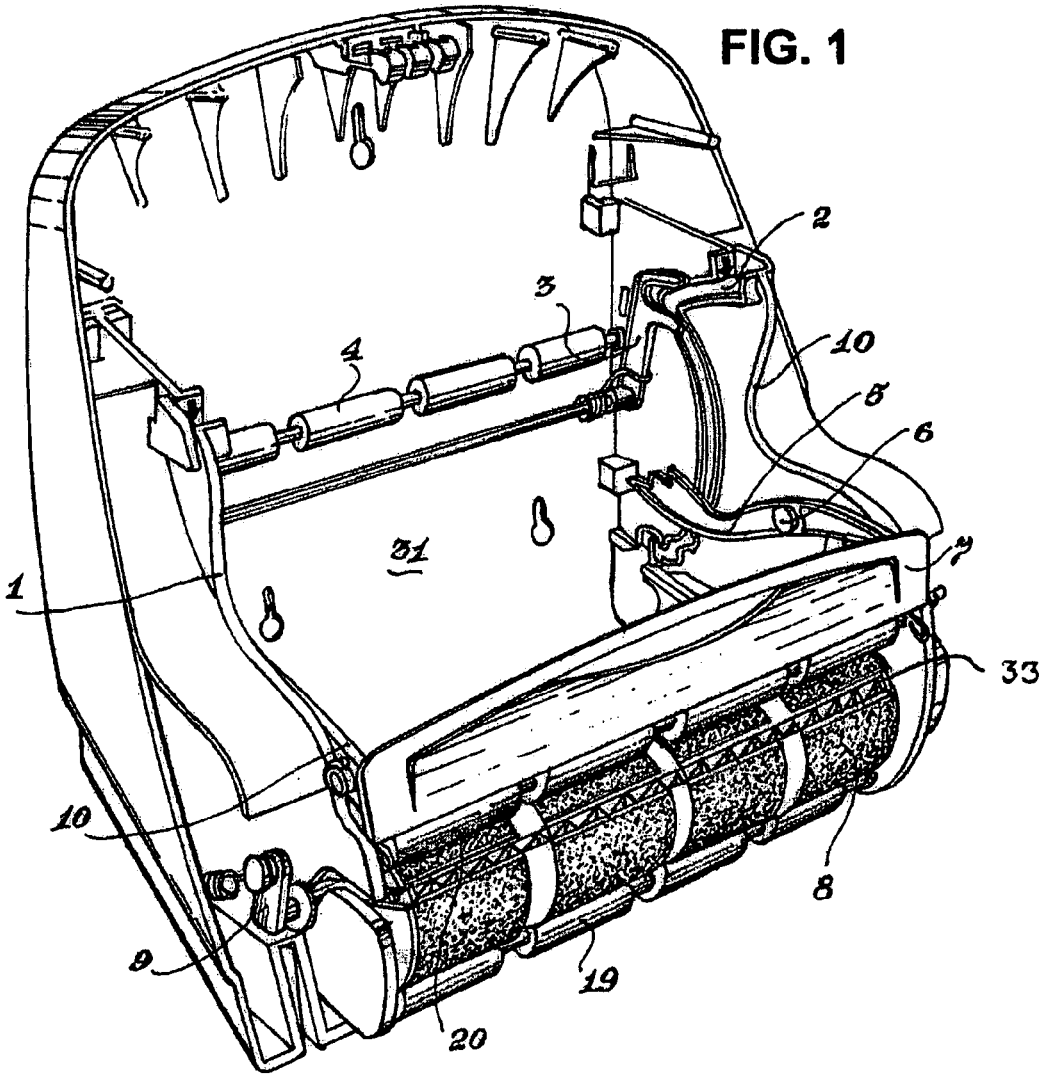
FIG. 1 shows a perspective view of the dispenser device of the present invention.
Figure 2:
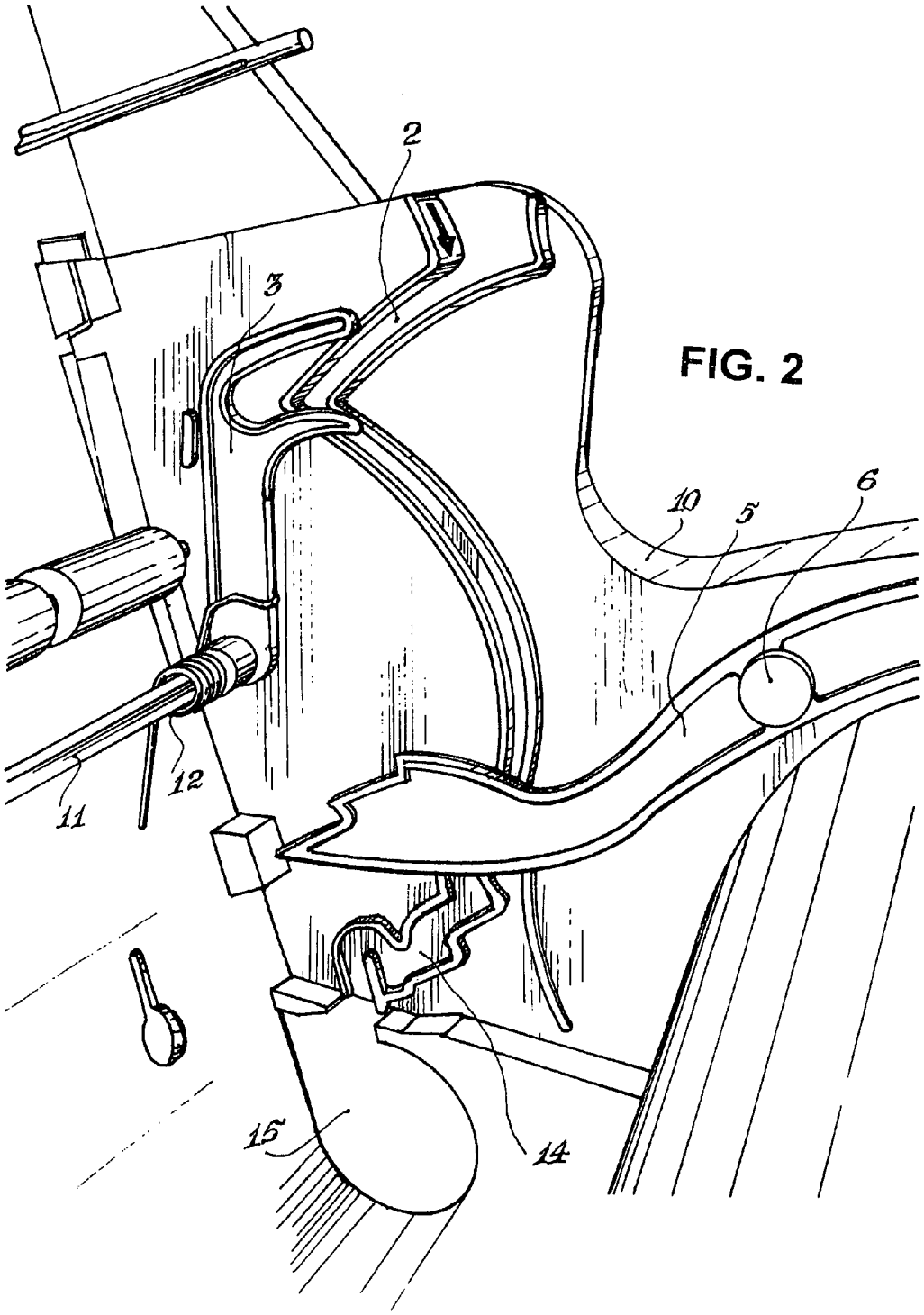
FIG. 2 shows a detail view of the mechanism of the dispenser according to the present invention.
Figure 3:
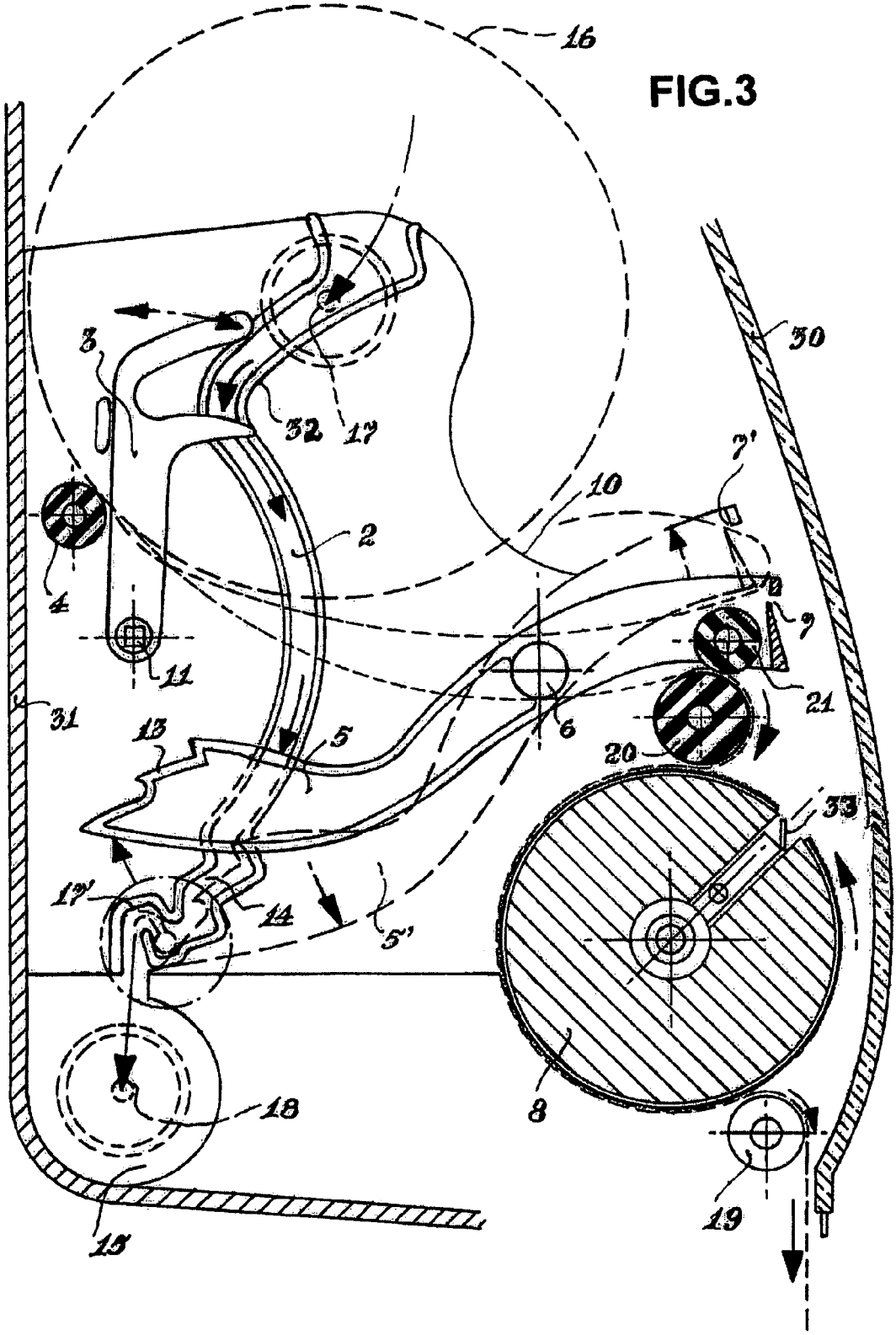
FIG. 3 shows a detail view of a section showing the operation of the dispenser.

While this invention has particular utility in connection with paper towels rolls, it is to be understood that its utility is not confined thereto.

In the figures it can be noted that the dispenser includes a housing 31 with a front transparent lid 30. Inside of this lid we can find two side walls 1 and 10, that have at the internal sides both grooves 2 that receive the protruding bolts 17 from the nucleus in which the towels are rolled, on the reel 16.

When the reel is collocated, making said bolts 17 at the ends of the nucleus penetrate in the superior part of the grooves 2, the periphery of the reel 16 leans on the gyratory roll 4.

As the device supplies the towels, the reel 16 rotates over said gyratory roll 4, simultaneously, the diameter of the reel decreases and the protruding bolts 17 slide descending along the groove 2 until it penetrates the horizontal "U"-shaped portion of the pieces 3 located against the walls 1 and 10.

The pieces 3 rotate around the axis 11 and are kept in a vertical position by means of the springs 12.

When the diameter of the reel 16 decreases in such a way that its radius is less than the distance between the curves 32 of the grooves 2 and the roll 4, the protruding bolts 17 make the piece 3 balance due to the weight of the reel, letting said reel fall through the groove 2 guided by the bolts 17.

During the fall, the bolts 17 hit against the posterior part of the lever 5 making the displacement of the same to position 5', rotating around its axis 6, thus the anterior part of the lever 5 elevates and makes roll 21 get separated from roll 20.

In the anterior part of the front end of the lever 5 there is an indicating sign that shows that the reel is running out of paper towels, with which a new reel can be collocated in the superior part while the previous nucleus delivers the last supply of towels.

At that step, the end of the roll of the new reel threads upwards through the slot 7, being in the position 7' while the towels of the previous reel are still being pulled by the roll 21 which is kept in contact with the driving roll 8 by means of the flange 9 and its corresponding spring, the driving roll 8 being creased and with a bigger diameter than the previous one. The towels are displaced on the surface of the driving roll and they emerge by the inferior part of the dispenser after passing by the exiting roll 19.

The nucleus 17, with the last towels passes by the inferior part with steps 14 of the groove 2, the steps matching with the posterior end 13 of the lever 5, until reaching the position 17' in which, with no towels left, is ejected by the posterior end of the lever 5 until it falls in the housing 15, from which it is extracted once empty through the sides.

When the front end of the lever 5 is lowered, the towels of the new reel are driven between the rolls 20 and 21 until the end penetrates in the slot 33 making it pass between the roll 20 and the driving roll 8 with which the new reel automatically starts dispensing towels.

Figure 4:
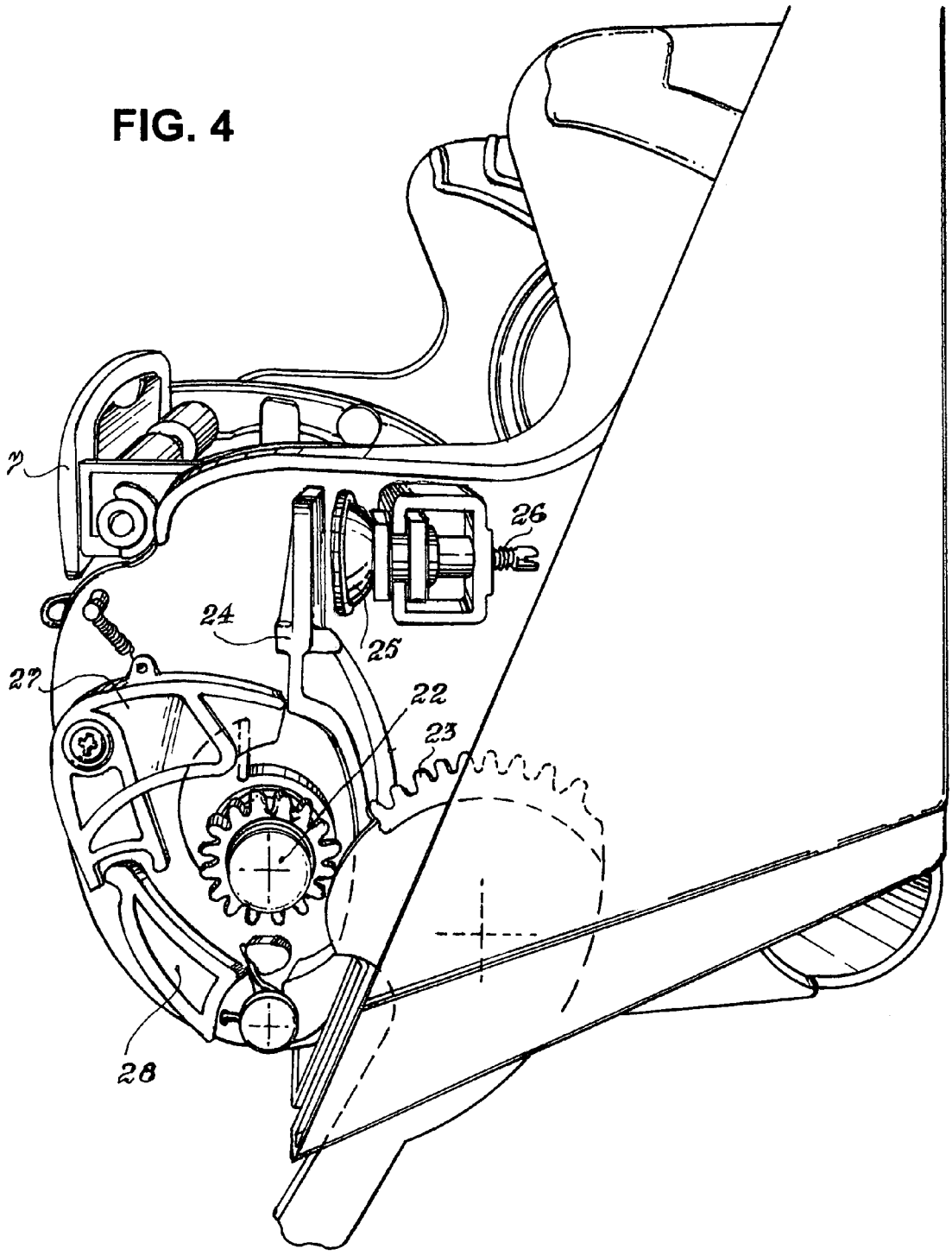
FIG. 4 shows a detailed view of the adjustable retarding mechanism of the present invention.

FIG. 4 shows the mechanism that, after the extraction of a towel, slows down the exit of the end of the following towel, as the vent 25 remains against a plane part of the lever 24, preventing, by means of the pieces 27 and 28, the rotation of the serrated wheel 22 until the vent 25 liberates the lever 24. The time in which the vent 25 remains against the lever 24 is regulated by means of a screw 26.

The serrated portion 23 is activated by means of a pulsator in order to rotate the serrated wheel 22 and get the end of the towel emerged from the dispenser.

What is claimed is:

1. A dispenser for roll of papers comprising:

a reel to enroll the roll of papers, wherein the roll is enrolled around a central nucleus having a first end and a second end;

the dispenser having a superior part, a backside, an inferior part, and lateral walls having an internal side and an external side;

wherein the nucleus has at both ends guiding means that slide along lateral descending grooves, each groove having a superior end located near the superior part of the dispenser and an inferior end located towards the backside of the dispenser;

wherein the reel can slide in a descending direction until the periphery of said reel is supported by a gyratory stop;

wherein the external diameter of the reel decreases as it continues sliding along the grooves until said guiding means enter into unlocking means of the reel making said reel descend until the guiding means push downwards a posterior end of a lever, wherein the other end of said lever having indicating means and threading means of a new reel; and wherein said posterior end ejects the nucleus when empty towards a cavity in the inferior part of the dispenser, in order to be taken away afterwards.

2. The device in accordance with claim 1 wherein said guiding means are bolts which are collocated in the superior end of said lateral grooves.

3. The device in accordance with claim 2 wherein said grooves are equal pieces which are located in the internal side of the lateral walls of the dispenser.

4. The device in accordance with claim 1 wherein said gyratory stop is a horizontal roll located in the superior part of the dispenser.

5. The device in accordance with claim 1 wherein said unlocking means are equal pieces placed at both ends of an oscillating rod, wherein said superior end of the grooves has the shape of a horizontal U, wherein bolts being are placed in said superior end of the grooves, and the inferior end of the grooves being extended with the ends attached to said oscillating rod.

6. The device in accordance with claim 1 wherein said device is activated by pulling the end of the paper that protrudes from the dispenser and has an adjustable retarding mechanism that avoids the roll from activating immediately after taking out the paper.

7. A paper roll dispenser for dispensing a paper roll comprising:

a central nucleus adapted to enroll the paper roll, the central nucleus having a first end, a second end, and protrusions means located at each end of the central nucleus;

a housing having an outside, an inside, a backside, and a front lid;

wherein the inside of the housing includes two side walls, each side wall having a) grooves to receive the protruding means of the nucleus, each groove having a superior end located near the lid and an inferior end located towards the backside of the housing, b) a piece connected to the inferior end of each groove, the piece having a first end connected to the inferior end of the groove and a second end connected to a rotating rod, wherein the first end includes a horizontal "U"-shaped portion;

wherein the roll is placed in the housing by penetrating said protruding means in the superior end of the grooves;

wherein the periphery of the paper on the roll leans on a rotating roll located near the backside of the housing;

wherein as the dispenser supplies the paper, the paper on the roll rotates over said rotating roll;

wherein as the diameter of the roll of paper decreases, the protruding means slide downward along the grooves until said protruding means enter into unlocking means making said roll descend until the guiding means push downwards a posterior end of a lever;

wherein the other end of said lever having indicating means and threading means of a new reel; and wherein said posterior end ejects the nucleus when it is empty towards a cavity in the inferior part of the dispenser.

8. The dispenser of claim 7 wherein the indicating means of the lever produces a sign that shows that the roll is running out of paper and a new roll of paper is positioned in the grooves.

* * * * *